US007137736B2

(12) United States Patent
Pawloski et al.

(10) Patent No.: US 7,137,736 B2
(45) Date of Patent: Nov. 21, 2006

(54) CLOSURE DEVICE FOR A RECLOSABLE POUCH

(75) Inventors: James C. Pawloski, Bay City, MI (US); Brian C. Dais, Howell, MI (US); David W. Gustafson, Midland, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 182 days.

(21) Appl. No.: 10/440,639

(22) Filed: May 19, 2003

(65) Prior Publication Data

US 2004/0234170 A1 Nov. 25, 2004

(51) Int. Cl.
*B65D 33/16* (2006.01)
*A44B 19/00* (2006.01)

(52) U.S. Cl. ..... 383/61.2; 383/63; 24/585.12

(58) Field of Classification Search ..... 383/63–64, 383/61.2; 24/399–400, 585.1, 585.12
See application file for complete search history.

(56) References Cited

U.S. PATENT DOCUMENTS

| | | | |
|---|---|---|---|
| 475,248 | A | 5/1892 | Pugsley |
| 1,746,565 | A | 2/1930 | Sundback |
| 1,959,318 | A | 5/1934 | Sundback |
| 2,354,485 | A | 7/1944 | Slaughter |
| 2,916,197 | A | 12/1959 | Detrie et al. |
| 3,038,225 | A | 6/1962 | Ausnit |
| 3,198,228 | A | 8/1965 | Naito et al. |
| 3,237,844 | A | 3/1966 | Hughes |
| 3,265,789 | A | 8/1966 | Hofer |
| 3,338,284 | A | 8/1967 | Ausnit |
| 3,338,285 | A | 8/1967 | Jaster |
| 3,340,116 | A | 9/1967 | Naito |
| 3,347,298 | A | 10/1967 | Ausnit et al. |
| 3,372,442 | A | 3/1968 | Ishimatsu |
| 3,410,327 | A | 11/1968 | Ausnit |
| 3,416,199 | A | 12/1968 | Imamura |
| 3,462,332 | A | 8/1969 | Goto |
| 3,528,600 | A | 9/1970 | White |
| 3,537,153 | A | 11/1970 | Ausnit |
| 3,565,147 | A | 2/1971 | Ausnit |
| 3,565,737 | A | 2/1971 | Lefevre et al. |
| RE27,174 | E | 9/1971 | Ausnit |
| 3,608,439 | A | 9/1971 | Ausnit |
| 3,715,420 | A | 2/1973 | Kiyono et al. |
| 3,780,781 | A | 12/1973 | Uramoto |
| 3,827,472 | A | 8/1974 | Uramoto |
| 3,840,418 | A | 10/1974 | Sabee |
| 3,841,816 | A | 10/1974 | Herz |

(Continued)

FOREIGN PATENT DOCUMENTS

| | | |
|---|---|---|
| CA | 764647 | 8/1967 |

(Continued)

OTHER PUBLICATIONS

Weg page from www.zippak.com "One-Time Locking Zipper", no date.

(Continued)

*Primary Examiner*—Jes F. Pascua

(57) ABSTRACT

A reclosable pouch comprises a body portion having first and second opposing bag walls, wherein each bag wall has an internal side. First and second closure mechanisms are disposed on the internal sides of the first and second bag walls, wherein the closure mechanisms are parallel and spaced between about 0.1 inch (2.54 mm) and 0.3 inch (7.62 mm) apart. Further, the first closure mechanism may have a first closure characteristic and the second closure mechanism may have a second closure characteristic different than the first closure characteristic.

60 Claims, 8 Drawing Sheets

U.S. PATENT DOCUMENTS

| | | | |
|---|---|---|---|
| 3,937,395 | A | 2/1976 | Lawes |
| RE28,969 | E | 9/1976 | Naito |
| 4,046,408 | A | 9/1977 | Ausnit |
| 4,087,577 | A | 5/1978 | Hendrickson |
| 4,139,664 | A | 2/1979 | Wenrick |
| 4,240,604 | A | 12/1980 | Brach |
| 4,263,079 | A | 4/1981 | Sutrina et al. |
| 4,268,938 | A | 5/1981 | Walchli |
| 4,279,677 | A | 7/1981 | Takahashi |
| 4,306,924 | A | 12/1981 | Kamp |
| 4,315,963 | A | 2/1982 | Havens |
| 4,354,541 | A | 10/1982 | Tilman |
| 4,363,345 | A | 12/1982 | Scheibner |
| 4,372,014 | A | 2/1983 | Simpson |
| 4,419,159 | A | 12/1983 | Herrington |
| 4,428,788 | A | 1/1984 | Kamp |
| 4,484,352 | A | 11/1984 | Katzin |
| 4,515,647 | A | 5/1985 | Behr |
| 4,522,678 | A | 6/1985 | Zieke |
| 4,532,652 | A | 7/1985 | Herrington |
| 4,555,282 | A | 11/1985 | Yano |
| 4,561,108 | A | 12/1985 | Kamp |
| 4,561,109 | A | 12/1985 | Herrington |
| 4,562,027 | A | 12/1985 | Behr et al. |
| 4,578,813 | A | 3/1986 | Ausnit |
| 4,615,045 | A | 9/1986 | Siegel |
| 4,618,383 | A | 10/1986 | Herrington |
| 4,655,862 | A | 4/1987 | Christoff et al. |
| 4,665,557 | A | 5/1987 | Kamp |
| 4,672,723 | A | 6/1987 | Hugues et al. |
| 4,673,383 | A | 6/1987 | Bentsen |
| 4,676,851 | A | 6/1987 | Scheibner et al. |
| 4,683,015 | A | 7/1987 | Wagers |
| 4,684,018 | A | 8/1987 | Jarund |
| 4,698,118 | A | 10/1987 | Takahashi |
| 4,701,358 | A | 10/1987 | Behr et al. |
| 4,709,399 | A | 11/1987 | Sanders |
| 4,710,968 | A | 12/1987 | Borchardt et al. |
| 4,727,709 | A | 3/1988 | Zieke et al. |
| 4,736,451 | A | 4/1988 | Ausnit |
| 4,736,496 | A | 4/1988 | Fisher et al. |
| 4,741,789 | A | 5/1988 | Zieke et al. |
| 4,755,248 | A | 7/1988 | Geiger et al. |
| 4,764,977 | A | 8/1988 | Wagers |
| 4,765,036 | A | 8/1988 | Iguchi et al. |
| 4,778,282 | A | 10/1988 | Borchardt et al. |
| 4,787,880 | A | 11/1988 | Ausnit |
| 4,791,710 | A | 12/1988 | Nocek et al. |
| 4,792,240 | A | 12/1988 | Ausnit |
| 4,796,300 | A | 1/1989 | Branson |
| 4,812,056 | A | 3/1989 | Zieke |
| 4,812,192 | A | 3/1989 | Woods et al. |
| 4,822,539 | A | 4/1989 | Tilman et al. |
| 4,829,641 | A | 5/1989 | Williams |
| 4,832,768 | A | 5/1989 | Takahashi |
| 4,834,554 | A | 5/1989 | Stetler, Jr. et al. |
| 4,846,586 | A | 7/1989 | Bruno |
| 4,854,917 | A | 8/1989 | Mizukoshi |
| 4,859,259 | A | 8/1989 | Scheibner |
| 4,869,725 | A | 9/1989 | Schneider et al. |
| 4,898,492 | A | 2/1990 | Janowski |
| 4,906,310 | A | 3/1990 | Broderick et al. |
| 4,907,321 | A | 3/1990 | Williams |
| 4,929,487 | A | 5/1990 | Tilman et al. |
| 4,964,739 | A | 10/1990 | Branson et al. |
| 5,009,828 | A | 4/1991 | McCree |
| 5,012,561 | A | 5/1991 | Porchia et al. |
| 5,017,021 | A | 5/1991 | Simonsen et al. |
| 5,022,530 | A | 6/1991 | Zieke |
| 5,023,122 | A | 6/1991 | Boeckmann et al. |
| 5,049,223 | A | 9/1991 | Dais et al. |
| 5,053,091 | A | 10/1991 | Giljam et al. |
| 5,056,933 | A | 10/1991 | Kamp |
| 5,067,822 | A | 11/1991 | Wirth et al. |
| 5,070,584 | A | 12/1991 | Dais et al. |
| 5,092,684 | A | 3/1992 | Weeks |
| 5,138,750 | A | 8/1992 | Gundlach et al. |
| 5,140,727 | A | 8/1992 | Dais et al. |
| 5,141,577 | A | 8/1992 | Porchia et al. |
| 5,154,086 | A | 10/1992 | Porchia et al. |
| 5,167,454 | A | 12/1992 | Woods et al. |
| 5,192,135 | A | 3/1993 | Woods et al. |
| 5,198,055 | A | 3/1993 | Wirth et al. |
| 5,209,574 | A | 5/1993 | Tilman |
| 5,211,481 | A | 5/1993 | Tilman |
| 5,235,731 | A | 8/1993 | Anzai et al. |
| 5,238,306 | A | 8/1993 | Heintz et al. |
| 5,248,201 | A | 9/1993 | Kettner et al. |
| 5,252,281 | A | 10/1993 | Kettner et al. |
| 5,259,904 | A | 11/1993 | Ausnit |
| 5,307,552 | A | 5/1994 | Dais et al. |
| 5,326,176 | A | 7/1994 | Domke |
| 5,356,222 | A | 10/1994 | Kettner et al. |
| 5,358,334 | A | 10/1994 | Simonsen |
| 5,366,294 | A | 11/1994 | Wirth et al. |
| 5,368,394 | A | 11/1994 | Scott et al. |
| 5,369,847 | A | 12/1994 | Naya et al. |
| 5,382,094 | A | 1/1995 | Ausnit |
| 5,384,942 | A | 1/1995 | Siegel |
| 5,388,910 | A | 2/1995 | Koyanagi |
| 5,397,182 | A | 3/1995 | Gaible et al. |
| 5,403,094 | A | 4/1995 | Tomic |
| 5,405,561 | A | 4/1995 | Dais et al. |
| 5,415,904 | A | 5/1995 | Takubo et al. |
| 5,462,360 | A | 10/1995 | Tilman et al. |
| 5,472,082 | A | 12/1995 | Thiele |
| 5,478,228 | A | 12/1995 | Dais et al. |
| 5,492,705 | A | 2/1996 | Porchia et al. |
| 5,509,734 | A | 4/1996 | Ausnit |
| 5,511,884 | A | 4/1996 | Bruno et al. |
| 5,520,463 | A * | 5/1996 | Tilman ..... 383/63 |
| 5,525,363 | A | 6/1996 | Herber et al. |
| 5,527,112 | A | 6/1996 | Dais et al. |
| 5,540,366 | A * | 7/1996 | Coomber ..... 224/677 |
| 5,558,439 | A | 9/1996 | Tilman |
| 5,564,834 | A | 10/1996 | Porchia et al. |
| 5,575,747 | A | 11/1996 | Dais et al. |
| 5,577,305 | A | 11/1996 | Johnson |
| 5,618,111 | A | 4/1997 | Porchia et al. |
| 5,647,100 | A | 7/1997 | Porchia et al. |
| 5,660,479 | A | 8/1997 | May et al. |
| 5,664,299 | A | 9/1997 | Porchia et al. |
| 5,669,715 | A | 9/1997 | Dobreski et al. |
| 5,672,009 | A | 9/1997 | Malin |
| 5,686,126 | A | 11/1997 | Noel et al. |
| 5,689,866 | A | 11/1997 | Kasai et al. |
| 5,713,669 | A | 2/1998 | Thomas et al. |
| 5,718,024 | A | 2/1998 | Robbins |
| 5,722,128 | A | 3/1998 | Toney et al. |
| 5,729,876 | A | 3/1998 | Johnson |
| 5,749,658 | A | 5/1998 | Kettner |
| 5,769,772 | A | 6/1998 | Wiley |
| 5,774,954 | A | 7/1998 | Ramsey et al. |
| 5,774,955 | A | 7/1998 | Borchardt et al. |
| 5,775,812 | A | 7/1998 | St. Phillips et al. |
| 5,783,012 | A | 7/1998 | Porchia et al. |
| 5,791,783 | A | 8/1998 | Porchia et al. |
| 5,794,315 | A | 8/1998 | Crabtree et al. |
| 5,804,265 | A | 9/1998 | Saad et al. |
| 5,809,621 | A | 9/1998 | McCree et al. |
| 5,817,380 | A | 10/1998 | Tanaka |
| 5,827,163 | A | 10/1998 | Kettner |
| 5,832,145 | A | 11/1998 | Dais et al. |
| 5,832,570 | A | 11/1998 | Thorpe et al. |

| | | | | |
|---|---|---|---|---|
| 5,832,699 | A | | 11/1998 | Zobel |
| 5,836,056 | A | | 11/1998 | Porchia et al. |
| 5,839,831 | A | | 11/1998 | Mazzocchi |
| D406,685 | S | | 3/1999 | McGinnis |
| 5,878,468 | A | | 3/1999 | Tomic et al. |
| 5,894,707 | A | | 4/1999 | May |
| 5,902,046 | A | | 5/1999 | Shibata |
| 5,911,508 | A | | 6/1999 | Dobreski et al. |
| 5,927,855 | A | | 7/1999 | Tomic et al. |
| 5,930,877 | A | | 8/1999 | Thorpe et al. |
| 5,933,927 | A | | 8/1999 | Miller et al. |
| 5,950,285 | A | | 9/1999 | Porchia et al. |
| 5,953,796 | A | | 9/1999 | McMahon et al. |
| 5,955,160 | A | | 9/1999 | Tanaka et al. |
| 5,962,040 | A | | 10/1999 | Dais et al. |
| 5,964,532 | A | | 10/1999 | St. Phillips et al. |
| 5,988,880 | A | | 11/1999 | Tomic |
| 6,004,032 | A | * | 12/1999 | Kapperman et al. ..... 383/5 |
| 6,009,603 | A | | 1/2000 | Gallagher |
| 6,010,244 | A | | 1/2000 | Dobreski et al. |
| 6,014,795 | A | | 1/2000 | McMahon et al. |
| 6,017,601 | A | * | 1/2000 | Amsel ..... 428/36.1 |
| 6,021,557 | A | | 2/2000 | Dais et al. |
| 6,030,122 | A | | 2/2000 | Ramsey et al. |
| 6,032,437 | A | | 3/2000 | Bois |
| 6,071,011 | A | | 6/2000 | Thomas et al. |
| 6,074,096 | A | | 6/2000 | Tilman |
| 6,077,208 | A | | 6/2000 | Larkin et al. |
| 6,080,252 | A | | 6/2000 | Plourde |
| 6,085,906 | A | | 7/2000 | Lambert |
| 6,110,586 | A | | 8/2000 | Johnson |
| 6,112,374 | A | | 9/2000 | Van Erden |
| 6,135,636 | A | | 10/2000 | Randall |
| 6,138,329 | A | | 10/2000 | Johnson |
| 6,148,588 | A | | 11/2000 | Thomas et al. |
| 6,149,302 | A | | 11/2000 | Taheri |
| 6,152,600 | A | | 11/2000 | Tomic |
| 6,156,363 | A | | 12/2000 | Chen et al. |
| 6,164,825 | A | | 12/2000 | Larkin et al. |
| 6,167,597 | B1 | | 1/2001 | Malin |
| 6,170,985 | B1 | | 1/2001 | Shabram, Jr. et al. |
| 6,185,796 | B1 | | 2/2001 | Ausnit |
| 6,187,396 | B1 | | 2/2001 | Möller |
| 6,212,061 | B1 | | 4/2001 | Irwin et al. |
| 6,217,215 | B1 | | 4/2001 | Tomic |
| 6,217,216 | B1 | | 4/2001 | Taheri |
| 6,221,484 | B1 | | 4/2001 | Leiter |
| 6,228,485 | B1 | | 5/2001 | Leiter |
| 6,231,236 | B1 | | 5/2001 | Tilman |
| 6,257,763 | B1 | | 7/2001 | Stolmeier et al. |
| 6,279,298 | B1 | | 8/2001 | Thomas et al. |
| 6,286,681 | B1 | | 9/2001 | Wilfong, Jr. et al. |
| 6,286,999 | B1 | | 9/2001 | Cappel et al. |
| 6,299,720 | B1 | | 10/2001 | Van Erden |
| 6,318,894 | B1 | | 11/2001 | Derenthal |
| 6,321,423 | B1 | | 11/2001 | Johnson |
| 6,360,513 | B1 | | 3/2002 | Strand et al. |
| 6,364,915 | B1 | | 4/2002 | Chapman-Irwin et al. |
| 6,461,042 | B1 | | 10/2002 | Tomic et al. |
| 6,461,043 | B1 | | 10/2002 | Healy et al. |
| 6,481,890 | B1 | | 11/2002 | VandenHeuvel |
| 6,487,758 | B1 | | 12/2002 | Shaffer et al. |
| 6,491,433 | B1 | | 12/2002 | Shabram, Jr. et al. |
| 6,539,594 | B1 | | 4/2003 | Kasai et al. |
| 6,582,122 | B1 | | 6/2003 | Shimizu |
| 6,592,260 | B1 | | 7/2003 | Randall et al. |
| 6,594,868 | B1 | | 7/2003 | Savicki |
| 6,594,872 | B1 | | 7/2003 | Cisek |
| 6,637,939 | B1 | | 10/2003 | Huffer |
| 6,686,005 | B1 | | 2/2004 | White et al. |
| 6,691,383 | B1 | | 2/2004 | Linton |
| 6,712,509 | B1 | | 3/2004 | Cappel |
| 2001/0043763 | A1 | | 11/2001 | Saad et al. |
| 2002/0090151 | A1 | | 7/2002 | Skeens et al. |
| 2002/0114540 | A1 | | 8/2002 | Shimizu |
| 2002/0153273 | A1 | | 10/2002 | Mallik et al. |
| 2002/0173414 | A1 | | 11/2002 | Leighton |
| 2003/0033694 | A1 | | 2/2003 | Cisek |
| 2003/0066267 | A1 | | 4/2003 | Nelson |
| 2003/0077008 | A1 | | 4/2003 | Plourde et al. |
| 2003/0077243 | A1 | | 4/2003 | Fitzhugh et al. |
| 2003/0167607 | A1 | | 9/2003 | Linton |
| 2003/0169947 | A1 | | 9/2003 | Taheri |
| 2003/0169948 | A1 | | 9/2003 | Fenzl et al. |
| 2003/0177619 | A1 | | 9/2003 | Cisek |
| 2003/0210836 | A1 | | 11/2003 | Strand |
| 2003/0219174 | A1 | | 11/2003 | Piechocki |
| 2003/0223654 | A1 | | 12/2003 | Gerrits |
| 2003/0223657 | A1 | | 12/2003 | Belias et al. |
| 2004/0001650 | A1 | | 1/2004 | Piechocki et al. |
| 2004/0047521 | A1 | | 3/2004 | Berich et al. |
| 2004/0078940 | A1 | | 4/2004 | Ishizaki |
| 2004/0091179 | A1 | | 5/2004 | Anderson |

FOREIGN PATENT DOCUMENTS

| | | |
|---|---|---|
| DE | 2 036 432 | 2/1971 |
| DE | 30 32 889 | 12/1981 |
| EP | 0 025 656 | 3/1981 |
| EP | 0 089 680 | 9/1983 |
| EP | 0 114 373 | 8/1984 |
| EP | 0 155 612 | 9/1985 |
| EP | 0 220 476 | 5/1987 |
| EP | 0 241 334 | 10/1987 |
| EP | 0 398 731 | 11/1990 |
| EP | 0 427 010 | 5/1991 |
| EP | 0 543 737 | 5/1993 |
| EP | 1 329 387 | 7/2003 |
| FR | 1493748 | 7/1967 |
| FR | 2 620 377 | 3/1989 |
| GB | 1092452 | 11/1967 |
| GB | 1156170 | 6/1969 |
| GB | 1326945 | 8/1973 |
| GB | 2 008 538 | 6/1979 |
| GB | 2 116 144 | 9/1983 |
| JP | 3 212355 | 9/1991 |
| JP | 04057768 | 2/1992 |
| JP | 6 99991 | 4/1994 |
| JP | 6 227551 | 8/1994 |
| WO | WO 88/04634 | 6/1988 |
| WO | WO 02/34634 | 5/2002 |

OTHER PUBLICATIONS

Web page from www.zippak.com "At-140 Zipper", no date.

Web page from www.ambag.com "Double Track Seal Top Bags", no date.

We pages from www.ambag.com "Ambag Corporation Custom Plain Bag Guidelines" (7 pages), no date.

Web pages from www.plastic-bags.net "Plastic Bags" (5 pages), no date.

Photo-micrograph of "Fresh Pack Zipper" from Chantler Packaging (see http://www.chantlerpackaging.com).

Web pages of"Ziplock Bag," by Rean Tai Plastic Co., Ltd at http://www.reantai.ttnet.net, (4 pages).

Photographs of "Zipper Bag" from Thai Griptech Co., Ltd, of Thailand (3 pages).

Photo-micrograph of "Zipper Bag" from Thai Griptech Co., Ltd. of Thailand.

Photographs of "Ziploc Heavy Duty Big Bags" from S. C. Johnson & Son, Inc., Large 21/4 Gallon Size (8.52 L), (4 pages).

Photographs of"Vegetables & Fruits Fresh Pack" from Slim Kitchen, 280mm×27mm, (3 pages).

Photographs of"Breast Milk Storage Bags" from Lansinoh, (4 pages).

Web pages of"Breast Milk Stroage Bags" by Lansinoh at http://store.babycenter.com/product/feeding/breastfeeding/pump accessories/3961, (2 pages).
Photographs of box for "Breast Milk Storage Bags" by Lansinoh, (2 pages).
Photographs of double zipper bag, name and origin unknown, (4 pages).
Web pages of"4-Mil Double-Track Zip Poly Bags" advertised by Realemall.com at http://office-supply.realemall.com/B-O-X-Packaging/4Mil-DoubleTrack-Zip-Poly-Bags.asp, 5 pages.
Web pages of"4-Mil Double-Track Zip Poly Bags" sold by Office Depot, 12" × 15", Box Of 500, at http://www.officedepot.com/ddSKU.do?level=SK&id=499978, 2 pages.
Web article "MS-1000 Offers Maximum Versatility" May 20, 2002 at http://www.packexpo.com/ve/34472/news/3070.html, 2 pages.
Web pages of"Drawstring Bags" advertised manufactured by Co-Ordinated Packaging, Inc. at http://www.co-ordinatedpackaging.com/specimen_bags.htm, 2 pages.

* cited by examiner

CLOSURE DEVICE FOR A RECLOSABLE POUCH

TECHNICAL FIELD

The present invention relates to closures for reclosable pouches, and more particularly, to such closures that guide a user's finger during closure of the pouch.

BACKGROUND ART

A thermoplastic bag for the storage of items typically includes a closure mechanism comprising male and female closure elements or profiles attached to an inner surface of a bag wall. In addition, thermoplastic bags are known having one or more pairs of ribs on outer surface(s) of the bag wall straddling at least one of the closure elements to guide a user's fingers when sealing the closure elements. Ribs have also been used on an internal surface of the thermoplastic bag closely spaced and adjacent the closure elements to assist in aligning the male and female closure elements when sealing the bag.

Hugues et al., U.S. Pat. No. 4,672,723 discloses a stabilized reclosable extruded plastic fastener. The fastener comprises a female profile on one wall of an extruded film material and a male profile on an opposite wall of the film material. Alignment ribs are spaced alongside and integral with a base area of the male profile to facilitate alignment of the male profile with the female profile during closing of the fastener.

Fisher U.S. Pat. No. 4,736,496, owned by the assignee of the present application, discloses a wide-track integral thermoplastic closure for a reclosable thermoplastic container. The closure includes ribs on either side of an element of the closure to assist in guiding a user's fingers during closure of the thermoplastic container.

Tilman et al., U.S. Pat. No. 4,929,487 discloses a thermoplastic bag having male and female fastener profiles and at least one alignment rib integral with the film and disposed on an outer surface of a bag wall opposite and aligned with the male profile. The rib functions to stiffen the area of film occupied by the male profile and facilitate the alignment of the male and female fastener profiles.

Porchia et al., U.S. Pat. No. 5,012,561, also owned by the assignee of the present application discloses a closure for reclosable thermoplastic containers. The closure comprises male and female closure elements, wherein the male closure element includes a male profile member and ribs disposed on either side of the male profile member and attached thereto by a base. The ribs are of a sufficient size and proximity to the male profile member so as to move together as a unit with the male profile member when the male and female closure elements are engaged or disengaged.

Dais et al., U.S. Pat. No. 5,140,727, owned by the assignee of the present application, discloses a zipper for reclosable thermoplastic bags and a process and apparatus for making the same. The zipper comprises opposing longitudinally extending interlockable rib and groove profiles. The rib profile defines a bulbous head that is generally triangularly shaped in cross-section, a stem, and optionally, one or more ribs adjacent the stem.

Tilman, U.S. Pat. No. 5,209,574 discloses a reclosable plastic bag having a sliderless zipper. The bag includes front and rear walls sealed along three edges to form a mouth or opening. Male and female profiles are attached to internal surfaces of the front and rear walls, respectively, wherein the male and female profiles are engageable to close the opening. Two ribs are provided on an outside surface of the front wall, one on each side of the male profile, to define a valley therebetween. Similarly, two additional ribs are formed on the outside surface of the rear wall, one on each side of female profile, to define a valley therebetween. The valleys act as finger guides for the user of the bag.

Scott et al., U.S. Pat. No. 5,368,394 discloses a reclosable bag having a stabilizer wedge zipper. The reclosable bag comprises front and rear walls sealed along three edges to form an opening. Male and female profiles are attached to internal faces of the walls. Each of the male and female profiles includes two stabilizer wedges that assist in transmitting forces to male and female profiles during opening of the bag.

Thermoplastic bags have also been developed having spaced multiple closure mechanisms. For example, a bag manufactured by Thai Griptech Company, Ltd. of Bangkok, Thailand, includes a first and second spaced closure mechanisms disposed at a top portion of the bag. Each closure mechanism includes a male closure portion and a female closure portion, wherein the male closure portions are disposed on a first bag wall and the female closure portions are disposed on a second bag wall opposite the male closure portions. The first closure mechanism is disposed approximately ⅜ths inch from the second closure mechanism. Apparently, the closure mechanisms have substantially identical closure characteristics in the sense of the force required to occlude the closure portions of each closure mechanism, the feel experienced by the user when occluding or de-occluding the closure portions of each closure mechanism, the resistances to de-occlusion to forces acting on either side of the closure mechanism, etc . . . Also, the intention is to fully close the bag by undertaking two zipping operation to separately close the closure mechanisms.

SUMMARY OF THE INVENTION

According to one aspect of the present invention, a reclosable pouch comprises a body portion having first and second opposing bag walls, wherein each bag wall has an internal side. First and second closure mechanisms are disposed on the internal sides of the first and second bag walls. The closure mechanisms are parallel and spaced between about 0.1 inch (2.54 mm) and 0.3 inch (7.62 mm) apart.

According to another aspect of the present invention, a reclosable pouch comprises a body portion having first and second opposing bag walls, wherein each bag wall has an internal side. First and second closure mechanisms are disposed on the internal sides of the first and second bag walls. The first closure mechanism provides a clicking feel during opening or closing of the first closure mechanism and further provides a first overall resistance against opening forces and the second closure mechanism provides a second overall resistance against opening forces wherein the second resistance is greater than the first overall resistance.

According to yet another aspect of the present invention, a reclosable pouch comprises a body portion having first and second opposing bag walls, wherein each bag wall has an internal side. First and second spaced closure mechanisms are disposed on the internal sides of the first and second bag walls. The first closure mechanism has male and female closure portions disposed on the first and second bag walls, respectively. The second closure mechanism has male and female closure portions disposed on the second and first bag walls, respectively.

According to yet another aspect of the present invention, a reclosable pouch comprises a body portion having first and second opposing bag walls, wherein each bag wall has an internal side. First and second spaced closure mechanisms are disposed on the internal sides of the first and second bag walls. The first closure mechanism has male and female closure portions disposed on the first and second bag walls, respectively. The second closure mechanism has male and female closure portions disposed on the second and first bag walls, respectively. A member is disposed between the closure mechanisms on one of the first and second bag walls.

According to a still further aspect of the present invention, a closure device includes first and second flanges, wherein each flange has an internal side, and first and second closure mechanisms disposed on the internal sides of the first and second flanges wherein the closure mechanisms are parallel and spaced between about 0.1 inch (2.54 mm) and 0.3 inch (7.62 mm) apart.

Other aspects and advantages of the present invention will become apparent upon consideration of the following detailed description and the attached drawings, in which like elements are assigned like reference numerals.

DESCRIPTION OF THE PREFERRED EMBODIMENTS

Figure 1:
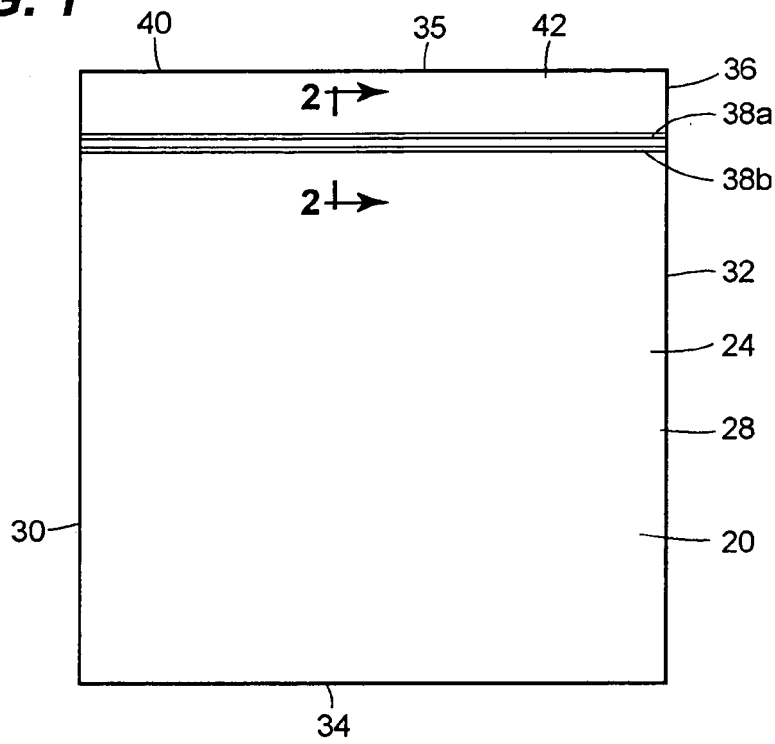
FIG. 1 is an elevational view of a reclosable thermoplastic storage bag according to the present invention.

Referring to FIG. 1, a reclosable pouch in the form of a thermoplastic storage bag 20 comprises first and second body portions 22, 24 joined to one another to form first and second bag walls 26, 28. The first and second bag walls 26, 28 are joined at first and second side portions 30, 32, respectively, and at a bottom portion 34. An opening 35 is disposed at a top portion 36 of the bag 20. First and second closure mechanisms 38*a*, 38*b* and two lips 40 are also disposed at the top portion 36 of the bag 20. The first closure mechanism 38*a* is disposed between the second closure mechanism 38*b* and an upper edge 42 of the top portion 36.

Figure 2A:
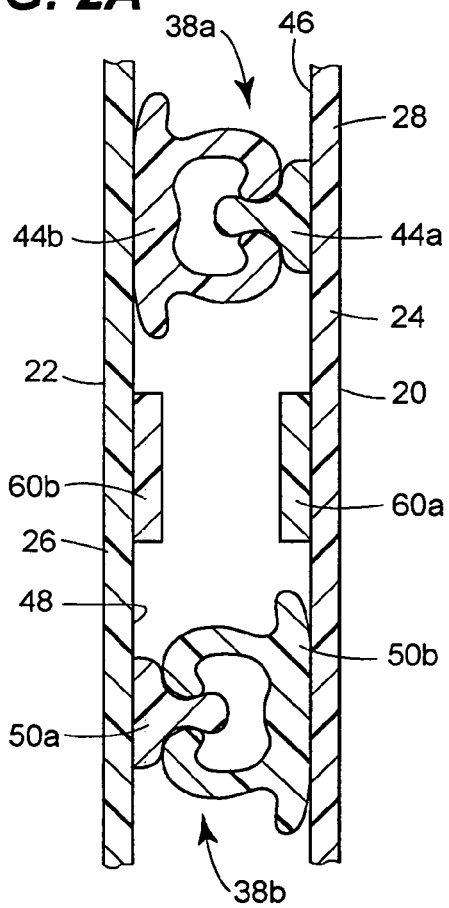
FIG. 2A is an enlarged, fragmentary, sectional view taken generally along the lines 2—2 of FIG. 1.
Figure 2B:
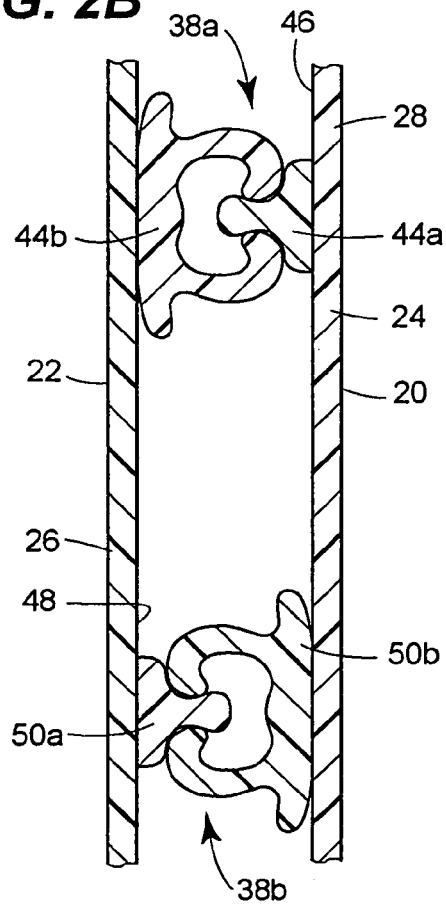
FIGS. 2B, 3, and 4 are views similar to FIG. 2A illustrating alternative embodiments of the present invention.

Referring to FIG. 2B, male and female closure elements or portions 44*a*, 44*b* of the closure mechanism 38*a* are disposed on opposing internal sides or surfaces 46, 48 of the first and second body portions 22, 24, respectively. In addition, in the embodiment of FIG. 2B, male and female elements or portions 50*a*, 50*b* of the closure mechanism 38*b* are disposed on the internal sides or surfaces 48, 46, respectively. Preferably, although not necessarily, the closure mechanism 38*a* is parallel to the closure mechanism 38*b* and the two are spaced from one another by a distance that is sufficiently small to create the perception that mechanisms act as a single closure. In addition, the mechanisms 38*a*, 38*b* are preferably disposed sufficiently far apart such that a user's fingers and/or thumb are guided during the closing operation. Typically, these results are accomplished by spacing the mechanisms 38*a*, 38*b* between about 0.1 inch (2.54 mm) and 0.3 inch (7.62 mm) apart, and, more preferably, between about 0.15 inch (3.81 mm) and about 0.25 inch (6.35 mm) apart and most preferably about 0.20 inch (5.08 mm) apart, although a different spacing may instead be used.

Preferably, the closure elements or portions 44, 50 have a cross sectional shape and/or may be formed in accordance with the teachings of Geiger, et al. U.S. Pat. No. 4,755,248, Zieke et al., U.S. Pat. No. 4,741,789, and/or Porchia et al., U.S. Pat. No. 5,012,561, owned by the assignee of the present application and the disclosures of which are hereby incorporated by reference herein. Also preferably, the first closure mechanism 38*a* exhibits a first closure characteristic and the second closure mechanism 38*b* exhibits a second closure characteristic different than the first closure characteristic. For example, either or both of the first and second closure mechanisms 38 may exhibit a relatively low level of resistance to bag opening forces but provide a high level of deformation so as to exhibit a clicking feel and/or sound when the bag is opened or closed. In addition, either or both of the first and second closure mechanisms 38 may exhibit a low level of deformation but provide a relatively high overall resistance to bag opening forces. Either or both of the male closure elements 44*a*, 50*a* may be symmetric or asymmetric about a longitudinal centerline thereof and either or both of the female closure elements 44*b*, 50*b* may be symmetric or asymmetric about a longitudinal centerline thereof. Thus, for example, either or both of the first and second closure mechanisms 38 may have an asymmetric configuration so that the closure mechanism 38 exhibits a first resistance to opening forces exerted on one side of the mechanism 38 and further exhibits a second, different resistance to opening forces exerted on another side of the mechanism 38.

In a specific embodiment, the first closure mechanism 38*a* exhibits a high degree of deformation so as to develop a clicking feel when the bag is opened or closed. Preferably, the first closure mechanism 38*a* is produced in accordance with the teachings of Dais et al., U.S. Pat. No. 5,140,727, owned by the assignee of the present application and the disclosure of which is hereby incorporated herein. In addition, the second closure mechanism 38*b* provides a relatively high overall resistance to opening forces. In addition, each closure mechanism 38*a* and 38*b* exhibits a first resistance to opening forces exerted from inside the bag (i.e., on the side between the bottom portion 34 of the bag and the closure mechanism 38) and a second, lower resistance to opening forces exerted from the opposite side of the closure mechanism 38 (i.e., on the side of the between the upper edge 42 and the closure mechanism 38.) This differential opening force characteristic is accomplished by asymmetrically configuring the male closure elements 44*a* and 50*a* and/or the female closure elements 44*b* and 50*b* as noted above. In the preferred embodiment, each of the closure mechanisms 38*a*, 38*b* exhibits substantially the same first resistance to opening forces exerted on the side between the upper edge 42 and the closure mechanism 38. In addition, each of the closure mechanisms 38*a*, 38*b* exhibits substantially the same second resistance to opening forces originating between the bottom portion 34 of the bag and the closure mechanisms 38. The second resistance is greater than the first resistance.

In addition, if desired, both of the closure mechanisms 38*a* and 38*b* or just the closure mechanism 38*b* may exhibit a high degree of deformation so as to develop a clicking feel when the bag is opened or closed. Still further, more than two closure mechanisms 38 may be provided wherein the closure mechanisms 38 have differing or the same closure characteristic(s) and the closure mechanisms act together as a single unit to allow the user to open and close the bag.

Figure 3:
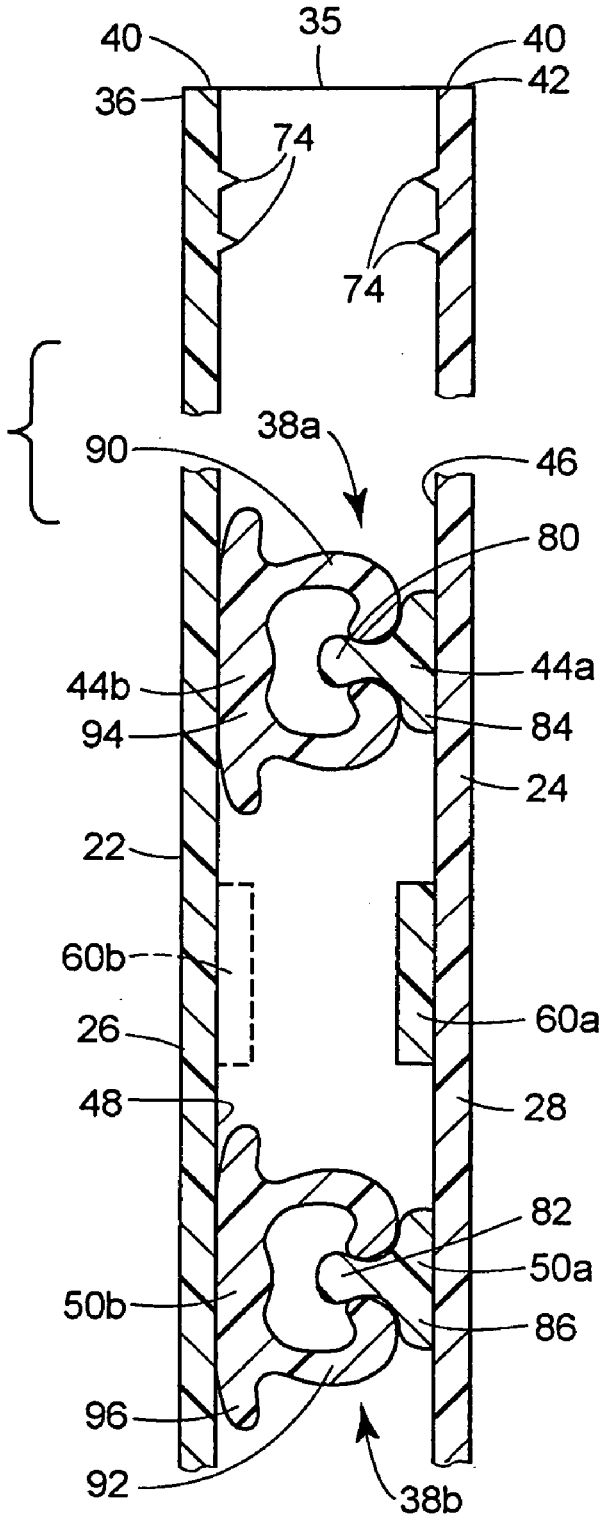
Figure 4:
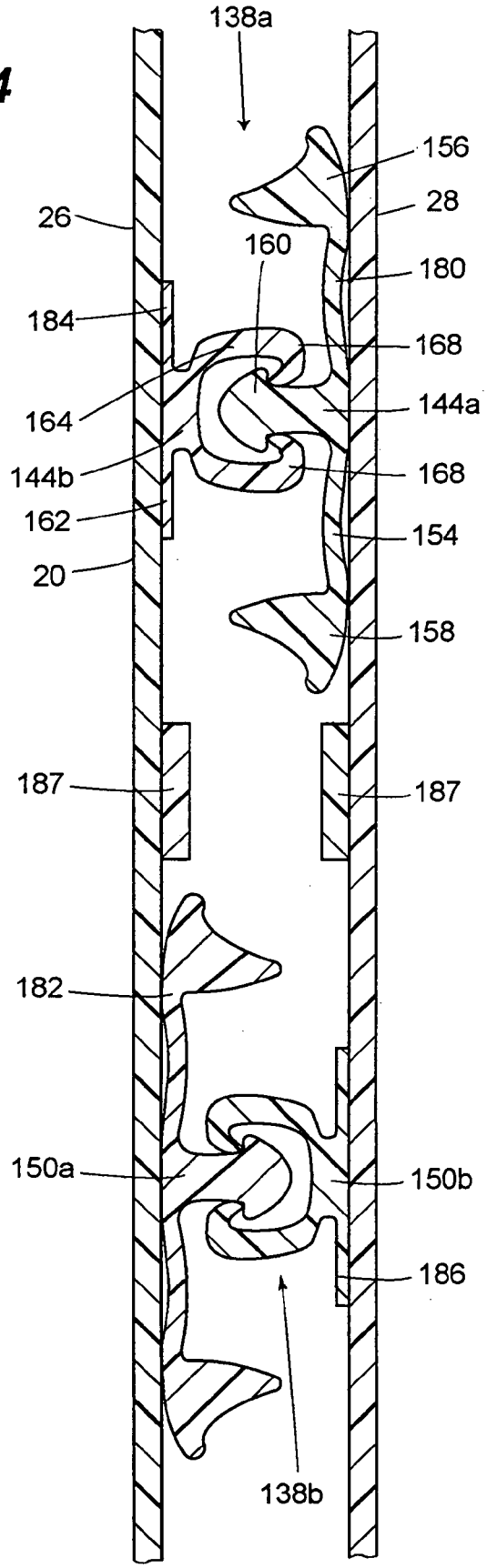

If desired, and as seen in FIGS. 2A, 3, and 4, one or more strips 60 could be provided between the closure mechanisms 38*a*, 38*b* (optionally out of contact, i.e., not touching, the adjacent closure elements) on either or both of the internal sides or surfaces 46, 48. The strips 60 may be colored or uncolored and may lend stiffness to the structure. According to a first embodiment, the male closure element 44*a*, the female closure element 50*b* and an optional strip 60*a* disposed between the elements 44*a* and 50*b* are colored pink, whereas the female closure element 44*b* and the male closure element 50*a* are colored blue. An optional further strip 60*b* may be disposed on the surface 48 between the closure elements 44*b* and 50*a* and may be colored blue. The size and shape of the strips 60 may be selected as desired to obtain a desired feel and/or stiffness.

As a further alternative, each of the optional strips 60 may simply comprise a thin colored coating, such as very thin layer of colored thermoplastic, a colored epoxy, a layer of paint, etc . . ..

FIG. 3 illustrates a further embodiment wherein like reference numbers denote structures common to the various embodiments. As seen in FIG. 3, the male closure elements 44*a* and 50*a* are disposed on the internal side or surface 46 and the female closure elements 44*b* and 50*b* are disposed on the internal side or surface 48. In this embodiment, a single strip 60*a* is provided between the male elements 44*a* and 50*a* on the internal side or surface 46. Additionally or alternatively, a strip 60*b* (seen in phantom in FIG. 3) may be provided between the female closure elements 44*b* and 50 on the internal side or surface 48. One or more additional strips may be provided on either or both surfaces 46, 48. If desired, other structures might be included with the closure mechanisms and the strips. For example, one or more guide ribs (not shown) could be provided to further assist in guiding of the user's fingers. Further, any or all of the strips 60 and/or other structures may be disposed between the closure mechanisms 38*a*, 38*b* or may be disposed outside of (i.e., above or below as seen in FIG. 1) the mechanisms 38*a*, 38*b*.

In any of the embodiments disclosed herein, one or more gripping ribs 74 may be disposed on the internal surfaces 46, 48 of the bag 20 between the closure mechanisms 38*a* and 38*b* and the top portion 36 of the bag 20, wherein the gripping ribs 74 are integrally extruded with the walls of the bag. Any number of gripping ribs 74 can be used, although space is necessary between adjacent ribs in order to facilitate a gripping action with a user's fingers. In a preferred embodiment, about six or seven gripping ribs 74 are disposed on each lip 40 of the bag.

As seen in FIG. 3, each male closure element 44*a*, 50*a* comprises an arrow-shaped engagement member 80, 82, respectively, and a base member 84, 86, respectively. Each female closure element 44*b*, 50*b* comprises a C-shaped profile member 90, 92, respectively, joined to base members 94, 96, respectively. The base members 84, 86 are only slightly wider than the engagement members 80, 82 and the base members 94, 96 are only slightly wider than the side-to-side extent (as seen in FIG. 2A) of the C-shaped profile members 90 and 92. The same is true of the embodiment of FIG. 2A. In both of these embodiments relatively little resin is required to form the closure mechanisms 38. In fact, it is believed that only a minimal increase in resin is needed to produce the closure elements 38 compared to a standard bag design utilizing a single closure mechanism, and yet a closure is obtained that has a wide-track feel and superior resistance to inadvertent opening.

FIG. 4 illustrates yet another embodiment of the present invention wherein the closure mechanisms 38*a*, 38*b* are replaced by closure mechanisms 138*a*, 138*b*. The mechanism 138*a* includes male and female closure elements 144*a*, 144*b* and the mechanism 138*b* includes male and female closure elements 150*a*, 150*b*. The mechanisms 138*a*, 138*b* are identical, and hence, only the closure mechanism 138*a* will be discussed in detail. The male closure element 144*a* of the closure mechanism 138*a* comprises a base 154 integral with flanking side members 156 and 158 and an arrow-shaped engagement member 160 that extends from the base 154. A female closure element 144*b* comprises a base 162 with a C-shaped profile member 164 extending therefrom, wherein the female closure element 144*b* is adapted to receive the male closure element 144*a* when pressure is exerted on the closure elements by a user's finger(s) during closing of the bag. The side members 156 and 158 are of a sufficient size and proximity to the engagement member 160 such that the side members 156 and 158 move together with the member 160 when the members 160 and 164 are engaged and disengaged. The side members 156 and 158 also have a height that is less than the height of the engagement member 160, and the members 156 and 158 extend beyond tips 168 of the female profile member 164 when the engagement member 160 is engaged with the female profile member 164. Thus, at such time, the tips 168 of the female profile member 164 reside between the side members 156 and 158 and the male engagement member 160.

As in the previous embodiments, the male closure elements 144*a*, 150*a* may be disposed on the same bag wall or on different bag walls, as may the female closure elements 144*b*, 150*b*.

As should be evident by a comparison of FIGS. 3 and 4, the base members 84, 86, 94, and 96 of FIG. 3 are replaced by elongate members 180, 182, 184, 186, respectively, and hence, more resin is required to produce the closure mechanisms 138*a*, 138*b* as compared to the closure mechanisms 38*a*, 38*b*. However, the elongate members 180–186 further promote guiding of the user's fingers and thumb during closing of the bag. One or more strips 187 identical or similar to the strip(s) 60 may be provided as noted in connection with the previous embodiments.

Figure 4A:
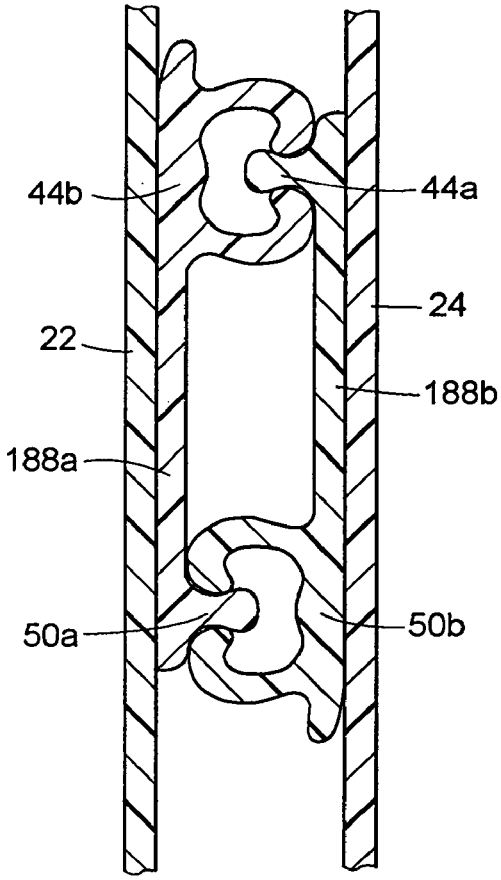
FIGS. 4A–4D are views also similar to FIG. 2A illustrating further alternative embodiments of the present invention.
Figure 4B:
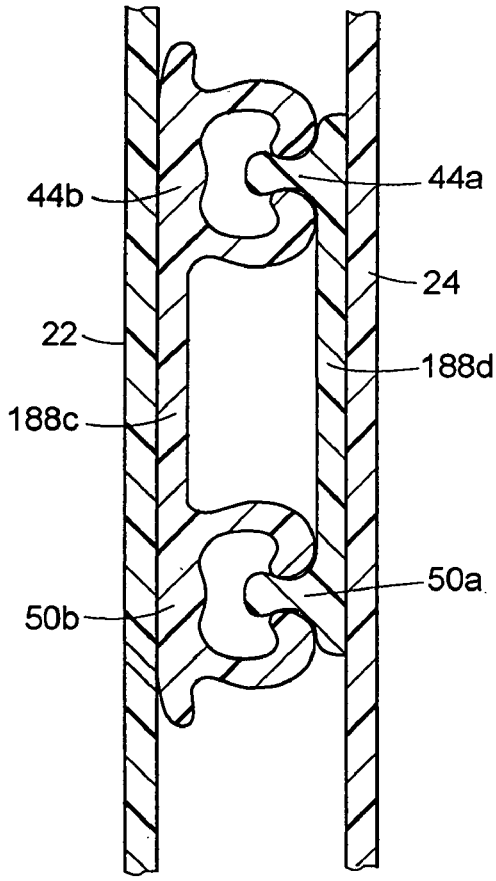

If desired, in any of the embodiments described above, adjacent closure elements may be interconnected by a web of film. Thus, for example, FIG. 4A illustrates modifications to the embodiment of FIG. 2A wherein the female closure element 44*b* is interconnected to the male closure element 50*a* by a web 188*a* that is integrally or separately extruded with the elements 44*b* and 50*a*. In addition, the male closure element 44*a* may be interconnected to the female closure element 50*b* by a web 188*b* that is integrally or separately extruded with the elements 44*a*, 50*b*. FIG. 4B illustrates the same features in connection with the embodiment of FIG. 3. That is, in FIG. 4B, the female closure elements 44*b* and 50*b* are interconnected by a web 188*c* whereas the male closure elements 44*a* and 50*a* are interconnected by a web 188*d*.

Optionally, in FIGS. 4A and 4B, the closure elements 44, 50 and/or the webs 188*a*–188*d* may have the same or different visual characteristic(s). Suitable visual characteristics include visual material characteristics such as transparency, translucency or opaqueness, coloring of transparent, translucent, or opaque material by dye or other suitable colorants, printing or embossing of indicia, or the like. For example, portions or the entirety of the web 188*a* may have a first visual characteristic, such as pink coloring, and portions or the entirety of the web 188*b* may have a second, different visual characteristic, such as blue coloring. In addition, and taking the embodiment of FIG. 4A as an example, portions or the entirety of one or both of the closure elements 44*a* and 50*b* may have the same or a different visual characteristic as the web 188*b* or 188*a*. The same may be true of the closure elements 44*b*, 50*a* relative to the visual characteristic of the web 188*a* or 188*b*. When the respective closure elements 44*a*, 44*b* and 50*a*, 50*b* are mated, the first and second visual characteristics, such as the pink and blue colorings, respectively (if used), blend together to form a single visual characteristic, such as purple coloring, indicating full closure thereof. If desired, central portions of the webs 188*a*, 188*b* intermediate the closure elements 44*b*, 50*a* and 44*a*, 50*b*, respectively, (or corresponding intermediate portions of the webs 188*c*, 188*d*) may be thickened so that such portions come into contact with one another when the closure elements 44, 50 are occluded. This can enhance the color change effect and provide a tactile confirmation of closure. In addition to the foregoing, any of the webs may include any tactile characteristic including, but not limited to, embossing, a thicker feeling, or a cushioned feeling. Alternatively, intermittent portions along the lengths of the closure elements 44, 50 and/or webs 188*a*–188*d* may have any visual or tactile characteristic. For example, referring to the embodiment of FIG. 4B, the web 188*c* may have a first alternating pattern formed by separate portions along the length thereof (i.e., from side-to-side of the bag 20) that have a visual characteristic comprising pink coloring and remainder portions of the web 188*c* intermediate the pink portions that have a different visual characteristic, such as translucent uncolored (i.e., clear) portions. In addition, the web 188*d* may have a second alternating pattern of pink and clear (or another visual characteristic) portions that are disposed at least partially out of phase with respect to the first alternating pink and clear (or other visual characteristic) pattern of the web 188*c*. Preferably, although not necessarily, the first alternating pattern is a regular pattern (i.e., the pink portions are all of substantially the same first length, and the remaining clear portions are all of substantially the same second length, where the first and second lengths are equal or unequal) and the second alternating pattern is identical to the first alternating pattern, but is displaced 180 degrees with respect thereto. When the closure elements 44*a*, 44*b* and 50*a*, 50*b* are correctly mated, the alternating pink and clear (or other visual characteristic) portions of the webs 188*c*, 188*d* come together to form a substantially full line of substantially uniform color (or other visual characteristic) to indicate closure thereof. As should be evident from the foregoing, any portion of any of the webs 188 and/or closure elements 44, 50 may be any visual characteristic, including different colors, clear, translucent, or opaque material, or printed indicia, and opposite webs and/or closure elements 44, 50 may have the same visual characteristic(s) or different visual characteristic(s) to assist in providing a visual indication of at least partial occlusion of the closure elements 44, 50.

Figure 4C:
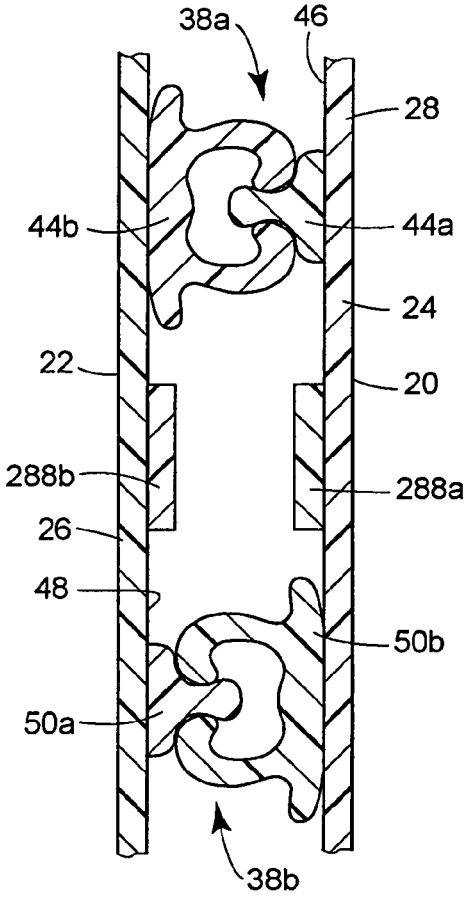
Figure 4D:
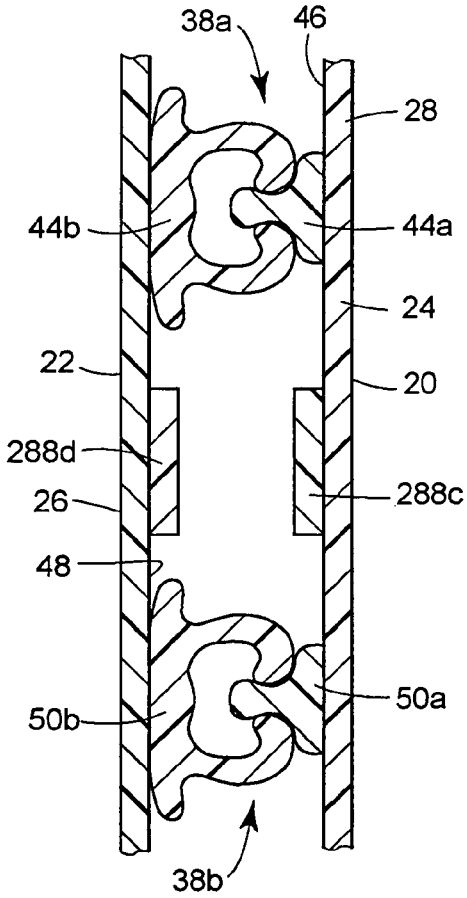

As seen in FIGS. 4C and 4D, webs 288*a*–288*d* may also be separately extruded onto the body portions 22, 24 intermediate and separate from the closure elements 44*a*, 44*b*, 50*a*, and 50*b*. Any of the embodiments described above in connection with FIGS. 4A and 4B are possible for the configurations shown in FIGS. 4C and 4D. The webs 288*a*–288*d* may also be made from any material including, but not limited to, a thermoplastic material or a foam material. For example, in FIG. 4C, the web 288*a* may have a first visual characteristic such as a translucent blue coloring and the web 288*b* may have a second visual characteristic such as a translucent yellow coloring, such that when the respective closure elements 44*a*, 44*b* and 50*a*, 50*b* are mated, the blue and yellow colors blend together to form a visual characteristic such as a green color that indicates full closure of the closure elements 44*a*, 44*b* and 50*a*, 50*b*. Further, in FIG. 4D, intermittent portions of the web 288*c* may have any visual characteristic, such as white coloring, to form a third regular or irregular alternating pattern of alternating white and clear portions and intermittent portions of the web 288*d* may have a visual characteristic including white coloring to form a fourth regular or irregular pattern of alternating white and clear portions wherein the third pattern is preferably (although not necessarily) identical to the fourth pattern, but displaced 180 degrees with respect thereto. As in the previous embodiment, when the closure elements 44*a*, 44*b* and 50*a*, 50*b* are mated, the alternating portions of the web portions 288*c*, 288*d* line up to from a full line of a visual characteristic (in this embodiment, a continuous white line) to indicate closure thereof. Also as in the previous embodiment, the thicknesses of the webs 288*c*, 288*d* may be such that at least portions of the webs 288*c*, 288*d* contact one another to enhance color change when the closure elements 44, 50 are properly mated.

As mentioned above, any of the webs 188*a*–188*d* or 288*a*–288*d* may have a visual characteristic including printed indicia thereon. For example, a first web may comprise a clear material with printed indicia including, for example, the word "closed" printed on an inner surface thereof and a second, opposing web may have a visual characteristic comprising a clear material. When the respective closure mechanisms are mated, the word "closed" appears through the second web to indicate full closure thereof. Alternatively, a word such as "closed" may be printed on inner surfaces of first and second clear webs at laterally spaced locations such that when the respective closure mechanisms are properly mated, the word "closed" appears clearly through the first and second webs at the laterally spaced locations to indicate full closure thereof. Printed indicia are not limited to words, but can also include any number, patterns, designs, or the like.

Reclosable thermoplastic storage bags as described herein can be produced by any suitable bag-making process, such as a cast post applied process, a cast integral process, a blown process or any other process known in the art. It should be noted that the extrusion die(s) used to form the closure mechanisms and strip(s) must include a suitable number of profile plates to form such structures. In addition, an air nozzle may be provided in association with each female closure element that blows air into the opening of each C-shaped female profile member to open the member as it is being extruded. In addition, one or more cooling water jets may be provided to cool the male and female closure elements after they are extruded.

Figure 5:
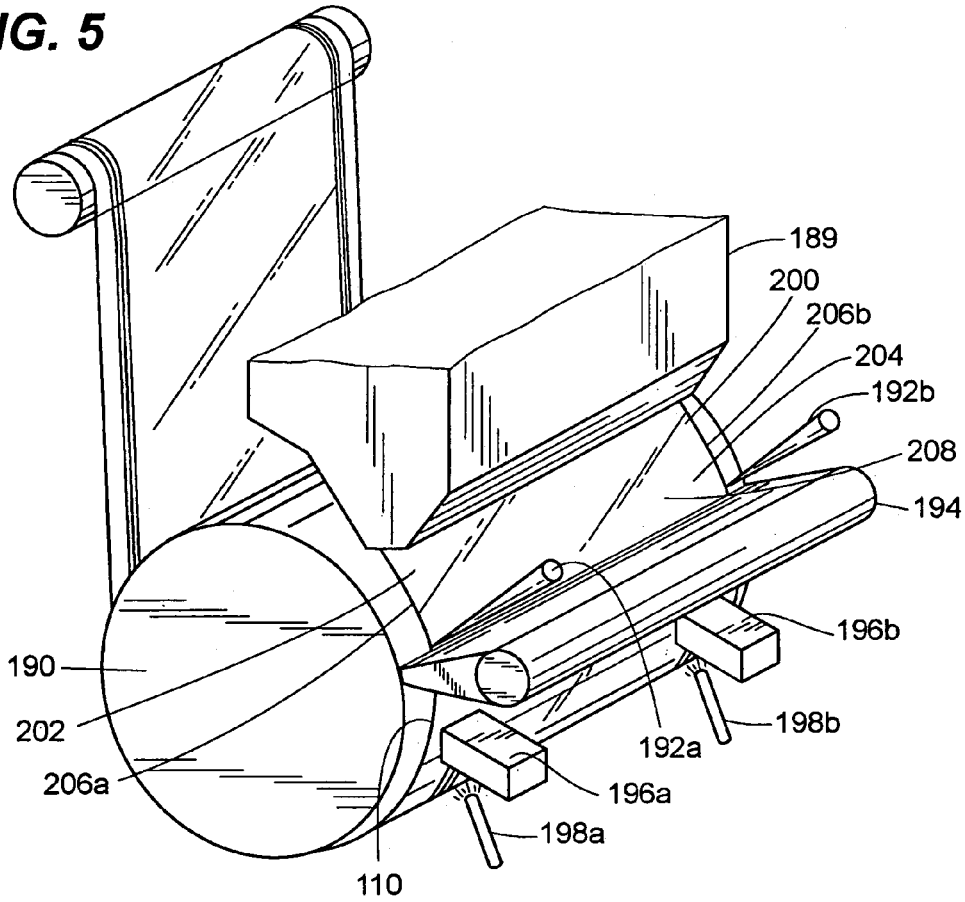
FIG. 5 is an isometric view of an apparatus for producing bags of the present invention.
Figure 6:
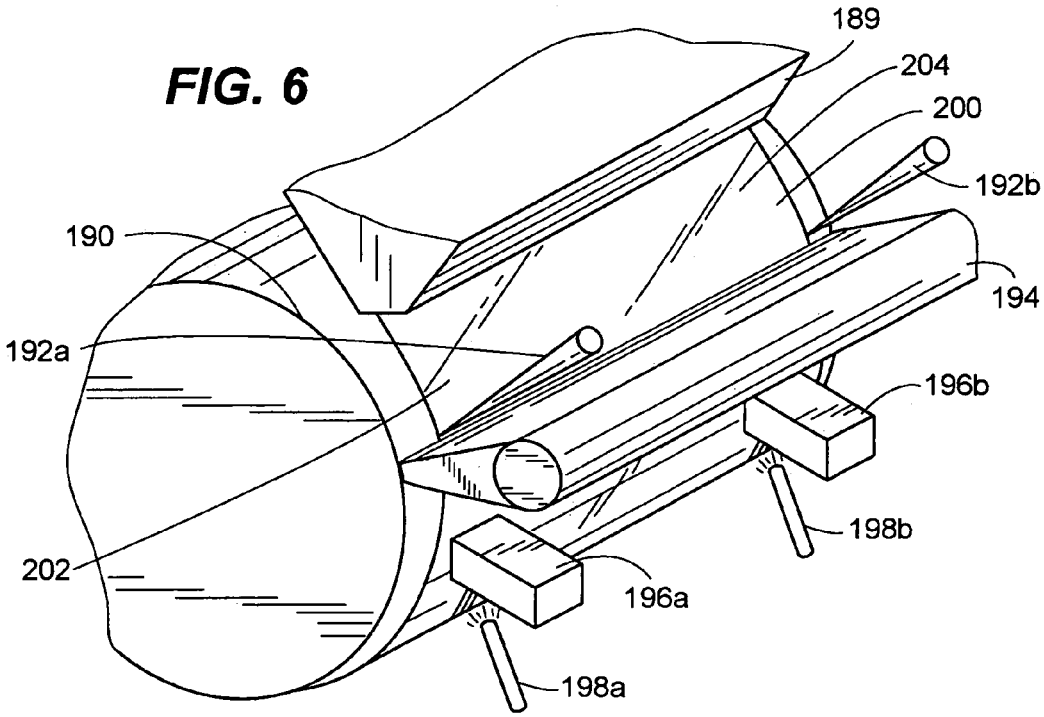
FIG. 6 is an enlarged, fragmentary isometric view of the apparatus of FIG. 5.

If desired, an alternative post applied process can be used to produce any of the bags disclosed herein, such as seen in FIGS. 5 and 6. Referring to such FIGS., the alternative post applied process utilizes an extrusion apparatus including a first extrusion slot die 189, a temperature-controlled driven casting roll 190, edge pinning devices or apparatus 192*a*, 192*b*, an air knife 194, second and third extrusion dies 196*a*, 196*b* (that are diagrammatically shown and which, together with the die 189, form the extrusion apparatus) and blowing apparatus 198*a*, 198*b*. The extrusion die 189 receives molten thermoplastic from an extruder (not shown) and deposits the thermoplastic in sheet form as a web 200 onto the casting roll 190. The extrusion die 189 includes a slot opening (not shown) that forms thickened areas 202, 204 at outside edge portions 206*a*, 206*b* of the resulting web 200 and a relatively thinner portion 208 intermediate the thickened areas 202, 204. The edge portions 206*a*, 206*b* are pinned to the casting roll 190 by the edge pinning devices 192*a*, 192*b*, respectively. The web 200 is then pinned across the entire width thereof (i.e., as a whole) to the casting roll 190 by the air knife 194.

Figure 7:
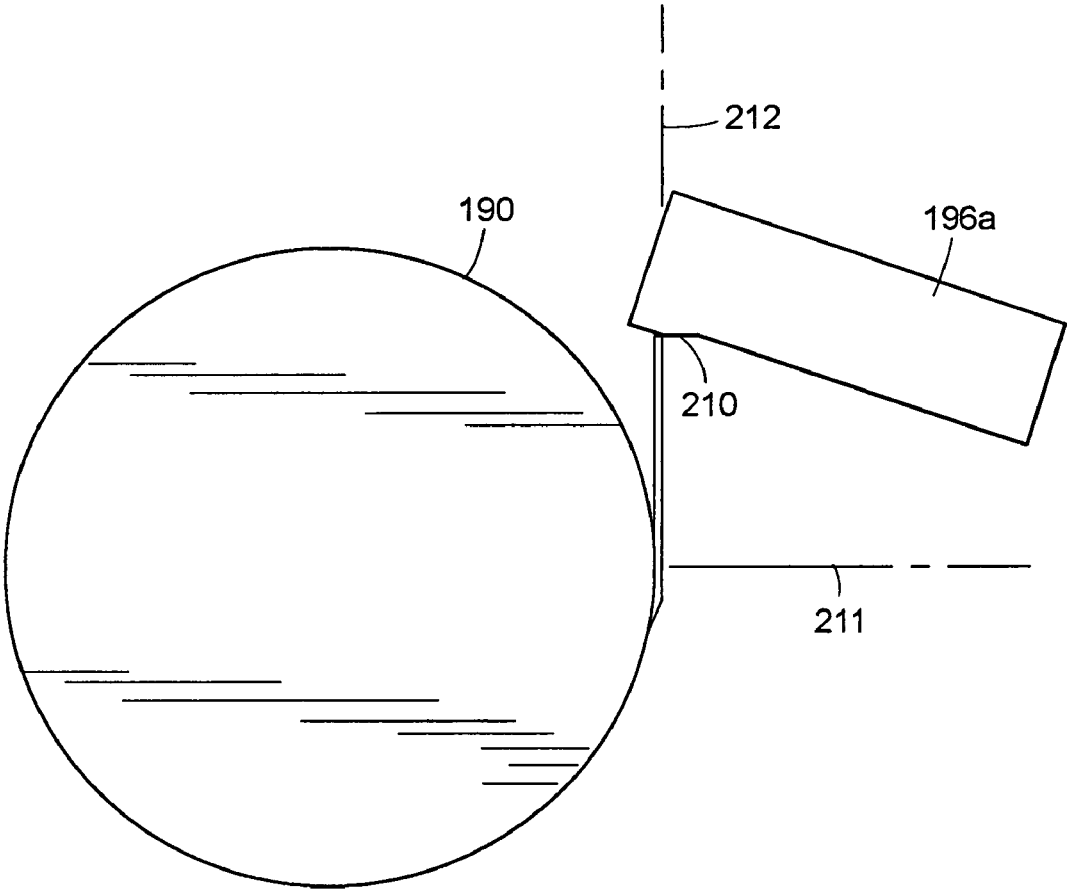
FIG. 7 is an enlarged end elevational view of the apparatus of FIGS. 5 and 6.

After the web 200 is pinned to the casting roll 190, the male and female closure elements 44, 50 or 144, 150 are formed on the web 100. Preferably, the extrusion dies 196*a*, 196*b* receive molten thermoplastic from separate extruders and extrude the male and female closure elements 44, 50 or 144, 150 onto the thickened areas 202, 204. Alternatively, the separate extrusion dies 196*a*, 196*b* may be replaced by a single extrusion die having two outlets at which the male and female closure elements 44, 50 or 144, 150 are simultaneously extruded onto the thickened areas 202, 204. As a still further alternative, each extrusion die 196*a*, 196*b* may be replaced by two or more extrusion dies that individually and separately extrude the closure elements 44, 50 or 144, 150 and the strip(s) 60, 187. In any event, as seen in FIG. 7, the angle of a face 210 of each die 196 is at least initially disposed substantially parallel to a horizontal radial line 211 extending from the center of the casting roll 190. The position of the die 196 (or each die 196*a*, 196*b* individually if separate dies are used) may then be adjusted by moving the die left, right, up, or down (all as seen in FIG. 7) or the die may be tipped (i.e., angularly displaced) to adjust the angle of the die face 210 to obtain desirable results. The closure elements 44, 50 or 144, 150 formed by the die(s) 196 may exit the die(s) 196 at a point coincident with a vertical tangent line 212 (FIG. 7) intersecting the surface of the casting roll 190 on the side of the casting roll 190 where the web 200 is first deposited thereon. Alternatively, the closure elements 44, 50 or 144, 150 formed by the die(s) 196 may exit the die(s) 196 at a point displaced to the right or left (as seen in FIG. 7) of the tangent line 212. If the extrudate exits the die(s) 196 at a point displaced to the right of the line 212, some provision must be made at the initiation of production to attach the extrudate stream to the casting roll 190. Thereafter, production may commence, (provided that the exit of the die(s) 196 is not disposed too far to the right of the tangent line 212) whereupon the melt strength of the extrude stream carries the stream into contact with the roll 190.

Once the molten thermoplastic from the die(s) 196 has been deposited onto the web 200, coolant is applied to the closure elements 44, 50 or 144, 150 by coolant apparatus (not shown) to bring the temperature thereof below the melting point of the thermoplastic material forming the closure elements 44, 50 or 144, 150 as quickly as possible. Preferably, the coolant comprises water or any other suitable cooling fluid and the coolant is applied to the material of the closure elements 44, 50 or 144, 150 only after such material contacts the material of the web 200 so that adhesion thereto is optimized. The web 200 and the closure elements 44, 50 or 144, 150 are maintained in contact with the temperature-controlled casting roll 190 for a period of time as the roll 190 is rotated so that the web 200 and closure elements 44, 50 or 144, 150 are further cooled. The casting roll 190 should be maintained at a temperature below the melting point of the thermoplastic material(s) forming the web 200 and the closure elements 44, 50 or 144, 150, typically about 20–80 degrees C.

Figure 8:
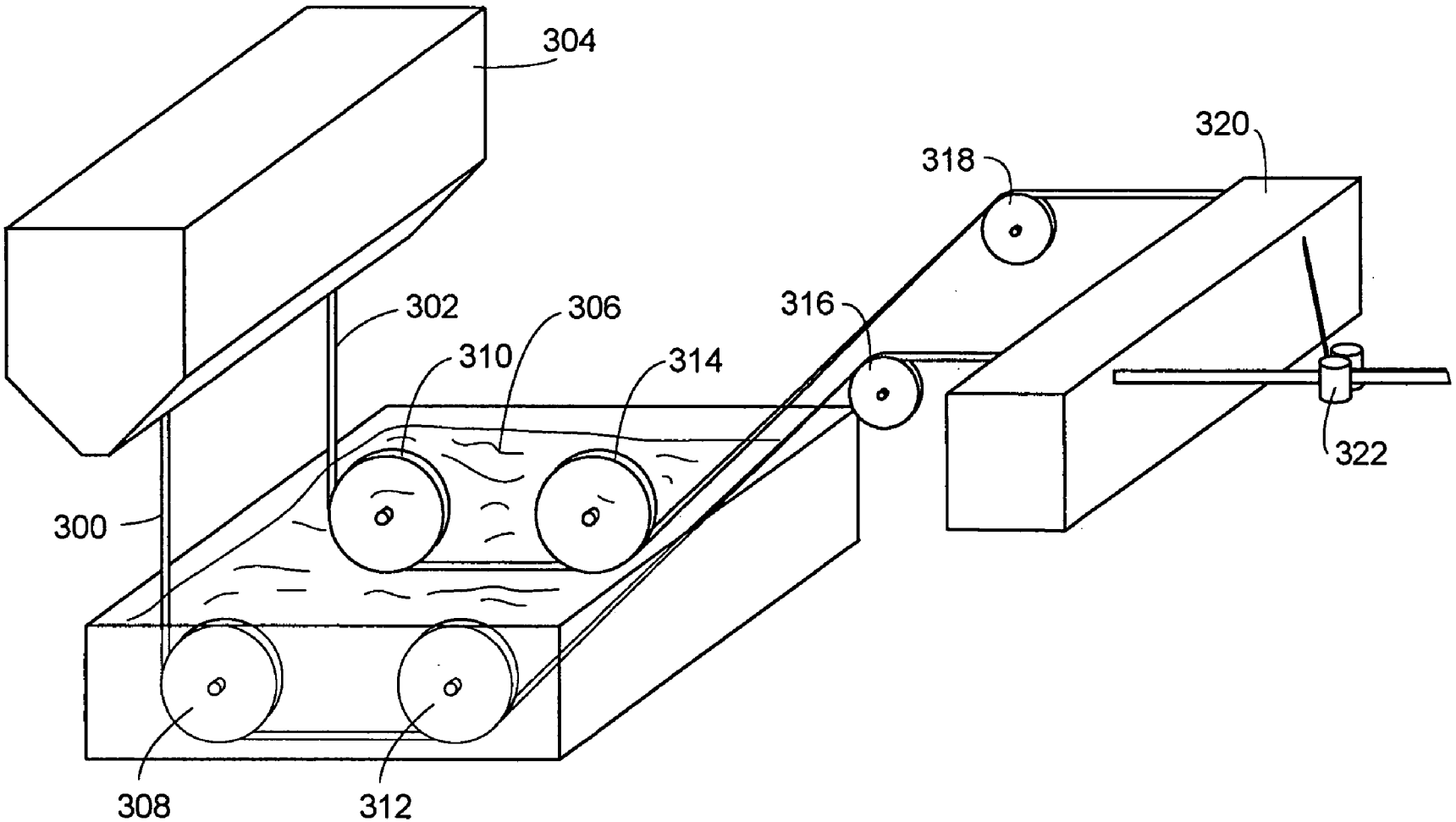
FIG. 8 is a diagrammatic isometric view of an extrusion apparatus for extruding zipper tape incorporating the present invention.

If desired, any of the closure elements and/or strips and/or other associated structures of the above embodiments can be integrally extruded on internal surfaces of flanges as zipper tape that is subsequently post-applied to film in a bag production process. For example, the closure elements 44, 50 or 144, 150 and/or the strips 60, 187 may be extruded with flanges as zipper tape portions 300, 302. In this embodiment, the gripping ribs 74 may also be formed on the zipper tape and the zipper tape may have relatively thicker portions at portions that ultimately form the top of the bag and relatively thinner portions at opposite portions where the zipper tape is to be joined to the film. For example, as seen in FIG. 8, zipper tape portions 300, 302 may be extruded separately by an extrusion die 304 into a water bath 306. If desired, more than one extrusion die may be employed for this purpose. The zipper tape portions 300, 302 extend about pulleys or rollers 308, 310, respectively, in the water bath 306 and may further extend about additional pulleys or rollers 312, 314 and 316, 318 out of the water bath 306. The zipper tape portions 300, 302 may thereafter pass through a dewatering station 320, where the water is removed therefrom, and the portions 300, 302 may be joined together (i.e., occluded) by nip rollers 322. The occluded portions 300, 302 may thereafter be stored on spools or reels or the occluded portions may be directly delivered to an in-line bag manufacturing apparatus, where the portions 300, 302 are laminated or otherwise secured to bag film.

INDUSTRIAL APPLICABILITY

The pouch described herein advantageously creates a perception of a wide-track feel that guides a user's fingers during closure thereof. Thus, closing efficiency is increased and the expenditure of wasted effort by the user is minimized.

Further, the pouch of the present invention can provide aural and tactile feedback of closing and opening of the pouch. Still further, the present pouch can provide a plurality of different closure characteristics and can provide greater security against inadvertent opening of the pouch. The distance between the closure mechanisms can be varied as desired, and the male and female closure elements may be disposed on either wall with or without strip(s) therebetween. Other structure(s) may be disposed between or outside of the closure mechanisms, as desired.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A reclosable pouch, comprising:

a body portion having first and second opposing bag walls, wherein each bag wall has an internal side; and first and second closure mechanisms disposed on the internal sides of the first and second bag walls wherein the closure mechanisms are parallel and spaced between 0.15 inch (3.81 mm) and 0.25 inch (6.35 mm) apart.

2. The reclosable pouch of claim 1, wherein the first closure mechanism exhibits a first closure characteristic and the second closure mechanism exhibits a second closure characteristic different than the first closure characteristic.

3. The pouch of claim 2, wherein the first closure characteristic comprises a level of deformation so as to provide a clicking feel or a clicking sound when the pouch is closed.

4. The pouch of claim 2, wherein the second closure characteristic comprises a first resistance to an opening force applied to one side of the second closure mechanism and a second resistance to an opening force applied to another side of the second closure mechanism wherein the first resistance is greater than the second resistance.

5. The pouch of claim 2, wherein the first closure mechanism exhibits a first overall resistance to opening forces and the second closure mechanism exhibits a second overall resistance to opening forces wherein the first overall resistance is different than the second overall resistance.

6. The pouch of claim 5, wherein the first closure characteristic comprises a level of deformation so as to provide a clicking feel or a clicking sound when the pouch is closed, and wherein the first closure mechanism has male and female closure portions disposed on the first and second bag walls, respectively, and the second closure mechanism has male and female closure portions disposed on the second and first bag walls, respectively.

7. The pouch of claim 6, wherein the first overall resistance is greater than the second overall resistance.

8. The pouch of claim 6, wherein the first overall resistance is less than the second overall resistance.

9. The pouch of claim 6, wherein the first closure mechanism is disposed nearer a top of the pouch than the second closure mechanism.

10. The pouch of claim 6, wherein the second closure mechanism is disposed nearer a top of the pouch than the first closure mechanism.

11. The pouch of claim 1, further including a stiffening member disposed between the closure mechanisms on one of the first and second bag walls.

12. The pouch of claim 1, wherein the first and second closure mechanisms exhibit the same closure characteristic.

13. The pouch of claim 12, wherein the closure characteristic comprises a level of deformation so as to provide a clicking feel or a clicking sound when the pouch is closed.

14. The pouch of claim 12, wherein the closure characteristic comprises a first resistance to an opening force applied to one side of the closure mechanism and a second resistance to an opening force applied to another side of the closure mechanism wherein the first resistance is greater than the second resistance.

15. The pouch of claim 1, wherein the first and second closure mechanisms are spaced about 0.2 inch (5.08 mm) apart.

16. The pouch of claim 1, further including at least one web interconnecting the first and second closure mechanisms.

17. The pouch of claim 1, further including first and second webs disposed between the first and second closure mechanisms.

18. The pouch of claim 17, wherein the first web includes a first visual characteristic.

19. The pouch of claim 18, wherein the second web includes a second visual characteristic different from the first visual characteristic.

20. The pouch of claim 19, wherein at least one of the first and second webs also includes a tactile characteristic.

21. The pouch of claim 19, wherein at least one of the first and second webs is a foam material.

22. The pouch of claim 1, wherein each of the first and second closure mechanisms includes male and female closure elements and wherein the female closure element of the first closure mechanism is adjacent the male closure element of the second closure mechanism on the first bag wall and the female closure element of the second closure mechanism is adjacent the male closure element of the first closure mechanism on the second bag wall.

23. The pouch of claim 22, wherein a strip is disposed between the female closure element of the first closure mechanism and the male closure element of the second closure mechanism.

24. The pouch of claim 23, wherein a further strip is disposed between the female closure element of the second closure mechanism and the male closure element of the first closure mechanism.

25. The pouch of claim 23, wherein a further web interconnects the female closure element of the second closure mechanism and the male closure element of the first closure mechanism.

26. The pouch of claim 22, wherein a web interconnects the female closure element of the first closure mechanism and the male closure element of the second closure mechanism.

27. The pouch of claim 1, wherein each of the first and second closure mechanisms includes male and female closure elements and wherein the female closure element of the first closure mechanism is adjacent the female closure element of the second closure mechanism on the first bag wall and the male closure element of the second closure mechanism is adjacent the male closure element of the first closure mechanism on the second bag wall.

28. The pouch of claim 27, wherein a strip is disposed between the female closure element of the first closure mechanism and the female closure element of the second closure mechanism.

29. The pouch of claim 28, wherein a further strip is disposed between the male closure element of the second closure mechanism and the male closure element of the first closure mechanism.

30. The pouch of claim 27, wherein a web interconnects the female closure element of the first closure mechanism and the female closure element of the second closure mechanism.

31. The pouch of claim 30, wherein a further web interconnects the male closure element of the second closure mechanism and the male closure element of the first closure mechanism.

32. A reclosable pouch, comprising:

a body portion having first and second opposing bag walls, wherein each bag wall has an internal side; and first and second closure mechanisms disposed on the internal sides of the first and second bag walls wherein the closure mechanisms are parallel and spaced between 0.15 inch (3.81 mm) and 0.25 inch (6.35 mm) apart;

wherein the first closure mechanism includes a level of deformation to provide a clicking feel or a clicking sound during opening or closing of the first closure mechanism and further provides a first overall resistance against opening forces and the second closure mechanism provides a second overall resistance against opening forces wherein the second overall resistance is greater than the first overall resistance.

33. The pouch of claim 32, wherein the second closure mechanism exhibits a first resistance to an opening force applied to one side of the second closure mechanism and a second resistance to an opening force applied to another side of the second closure mechanism wherein the first resistance is greater than the second resistance.

34. The pouch of claim 33, wherein the first closure mechanism is disposed nearer a top of the pouch than the second closure mechanism.

35. The pouch of claim 33, wherein the second closure mechanism is disposed nearer a top of the pouch than the first closure mechanism.

36. The pouch of claim 32, further including a stiffening member disposed between the closure mechanisms on one of the first and second bag walls.

37. The pouch of claim 32, wherein the first closure mechanism has male and female closure portions disposed on the first and second bag walls, respectively, and the second closure mechanism has male and female closure portions disposed on the second and first bag walls, respectively.

38. The pouch of claim 37, further including at least one web interconnecting the closure portions disposed on at least one of the first and second bag walls.

39. The pouch of claim 32, wherein the first closure mechanism has male and female closure portions disposed on the first and second bag walls, respectively, and the second closure mechanism has male and female closure portions disposed on the first and second bag walls, respectively.

40. The pouch of claim 39, further including at least one web interconnecting the closure portions disposed on at least one of the first and second bag walls.

41. A reclosable pouch, comprising:

a body portion having first and second opposing bag walls, wherein each bag wall has an internal side; and first and second spaced closure mechanisms disposed on the internal sides of the first and second bag walls wherein the closure mechanisms are parallel and spaced between 0.15 inch (3.81 mm) and 0.25 inch (6.35 mm) apart;

wherein the first closure mechanism includes a level of deformation to provide a clicking feel or a clicking sound during opening or closing of the first closure mechanism and further provides male and female closure portions disposed on the first and second bag walls, respectively, and the second closure mechanism has male and female closure portions disposed on the second and first bag walls, respectively.

42. The pouch of claim 41, wherein the second closure characteristic comprises a first resistance to an opening force applied to one side of the second closure mechanism and a second resistance to an opening force applied to another side of the second closure mechanism wherein the first resistance is greater than the second resistance.

43. The pouch of claim 42, wherein the first closure mechanism exhibits a first overall resistance to opening forces and the second closure mechanism exhibits a second overall resistance to opening forces wherein the first overall resistance is different than the second overall resistance.

44. The pouch of claim 43, wherein the first overall resistance is greater than the second overall resistance.

45. The pouch of claim 43, wherein the first overall resistance is less than the second overall resistance.

46. The pouch of claim 43, wherein the first closure mechanism is disposed nearer a top of the pouch than the second closure mechanism.

47. The pouch of claim 43, wherein the second closure mechanism is disposed nearer a top of the pouch than the first closure mechanism.

48. The pouch of claim 43, further including a stiffening member disposed between the closure mechanisms on one of the first and second bag walls.

49. The pouch of claim 43 wherein the first closure mechanism has male and female closure portions disposed on the first and second bag walls, respectively, and the second closure mechanism has male and female closure portions disposed on the second and first bag walls, respectively.

50. The pouch of claim 49, further including at least one web interconnecting the closure portions disposed on at least one of the first and second bag walls.

51. A reclosable pouch, comprising a body portion having first and second opposing bag walls, wherein each bag wall has an internal side;

first and second spaced closure mechanisms disposed on the internal sides of the first and second bag walls wherein the closure mechanisms are parallel and spaced between 0.15 inch (3.81 mm) and 0.25 inch (6.35 mm) apart;

wherein the first closure mechanism has male and female closure portions disposed on the first and second bag walls, respectively, and the second closure mechanism has male and female closure portions disposed on the second and first bag walls, respectively; and a member disposed between the closure mechanisms on one of the first and second bag walls.

52. The pouch of claim 51, wherein the first closure mechanism includes a level of deformation to provide a clicking feel or a clicking sound when the pouch is closed.

53. The pouch of claim 52, wherein the second closure characteristic comprises a first resistance to an opening force applied to one side of the second closure mechanism and a second resistance to an opening force applied to another side of the second closure mechanism wherein the first resistance is greater than the second resistance.

54. The pouch of claim 53, wherein the first closure mechanism exhibits a first overall resistance to opening forces and the second closure mechanism exhibits a second overall resistance to opening forces wherein the first overall resistance is different than the second overall resistance.

55. The pouch of claim 54, wherein the first overall resistance is greater than the second overall resistance.

56. The pouch of claim 54, wherein the first overall resistance is less than the second overall resistance.

57. The pouch of claim 54, wherein the first closure mechanism is disposed nearer a top of the pouch than the second closure mechanism.

58. The pouch of claim 54, wherein the second closure mechanism is disposed nearer a top of the pouch than the first closure mechanism.

59. The pouch of claim 51, wherein the member comprises a web interconnecting the closure portions disposed on the one of the first and second bag walls.

60. The pouch of claim 51, wherein the member comprises a stiffening member disposed between but not touching the closure portions disposed on the one of the first and second bag walls.

* * * * *